US005944764A

United States Patent [19]

Henderson et al.

[11] Patent Number: 5,944,764

[45] Date of Patent: Aug. 31, 1999

[54] METHOD FOR MONITORING THE WORK CYCLE OF EARTH MOVING MACHINERY DURING MATERIAL REMOVAL

[75] Inventors: Daniel E. Henderson, Washington; Gregory R. Harrod, Peoria, both of Ill.

[73] Assignee: Caterpillar Inc., Peoria, Fla.

[21] Appl. No.: 08/881,015

[22] Filed: Jun. 23, 1997

[51] Int. Cl.[6] ..... G01C 21/00

[52] U.S. Cl. ..... 701/50; 701/213; 701/207; 342/457; 37/414; 37/348; 364/151

[58] Field of Search ..... 701/50, 201, 208, 701/215, 216, 26, 202, 210, 207, 225, 1; 342/357, 457; 37/907, 414, 348, 347, 905; 356/312, 3.09, 4.08, 141.3, 141.4, 141.5; 364/151

[56] References Cited

U.S. PATENT DOCUMENTS

| | | | |
|---|---|---|---|
| 4,026,423 | 5/1977 | Schade et al. | 214/133 |
| 4,380,050 | 4/1983 | Tanner | 701/301 |
| 4,633,383 | 12/1986 | Omachi et al. | 364/167.04 |
| 4,677,555 | 6/1987 | Goyet | 701/50 |
| 4,698,775 | 10/1987 | Koch et al. | 364/478.06 |
| 4,785,761 | 11/1988 | Greenbank | 118/682 |
| 4,807,131 | 2/1989 | Clegg | 701/1 |
| 4,807,136 | 2/1989 | Rutkowski et al. | 701/50 |
| 4,814,711 | 3/1989 | Olsen et al. | 324/331 |
| 4,818,107 | 4/1989 | Ono et al. | 356/375 |
| 4,820,041 | 4/1989 | Davidson et al. | 356/3.12 |
| 4,831,539 | 5/1989 | Hagenbuck | 701/207 |
| 4,833,615 | 5/1989 | Bitner et al. | 701/124 |
| 4,903,212 | 2/1990 | Yokouchi et al. | 701/216 |
| 4,915,757 | 4/1990 | Rando | 156/64 |
| 4,919,222 | 4/1990 | Kyrtsos et al. | 177/139 |
| 4,949,263 | 8/1990 | Jurca | 701/50 |
| 4,965,586 | 10/1990 | O'Neill et al. | 342/357 |
| 5,019,983 | 5/1991 | Schutten et al. | 701/50 |
| 5,065,326 | 11/1991 | Sahm | 701/50 |
| 5,100,229 | 3/1992 | Lundberg et al. | 356/3.12 |
| 5,113,349 | 5/1992 | Nakamura | 364/478.03 |
| 5,144,317 | 9/1992 | Duddek et al. | 342/357 |
| 5,148,110 | 9/1992 | Helms | 324/323 |
| 5,257,177 | 10/1993 | Bach et al. | 364/167.01 |
| 5,265,025 | 11/1993 | Hirata | 701/200 |
| 5,287,280 | 2/1994 | Yamamoto et al. | 701/350 |
| 5,295,317 | 3/1994 | Perrott | 37/348 |
| 5,321,637 | 6/1994 | Anderson et al. | 702/174 |
| 5,334,987 | 8/1994 | Teach | 342/357 |
| 5,359,521 | 10/1994 | Kyrtsos et al. | 701/215 |
| 5,404,661 | 4/1995 | Sahm et al. | 37/348 |
| 5,438,771 | 8/1995 | Sahm et al. | 37/348 |
| 5,471,391 | 11/1995 | Gudat et al. | 701/50 |
| 5,493,494 | 2/1996 | Henderson | 701/300 |
| 5,546,093 | 8/1996 | Gudat et al. | 342/357 |
| 5,553,407 | 9/1996 | Stump | 37/348 |
| 5,631,658 | 5/1997 | Gudat et al. | 701/50 |
| 5,646,844 | 7/1997 | Gudat et al. | 701/50 |
| 5,806,016 | 9/1998 | Henderson et al. | 701/50 |
| 5,815,826 | 9/1998 | Henderson et al. | 701/50 |

FOREIGN PATENT DOCUMENTS

| | | | |
|---|---|---|---|
| 3-39525 | 2/1991 | Japan | E02F 3/84 |
| 2315137 | 1/1998 | United Kingdom | G05D 1/02 |
| 95/30880 | 11/1995 | WIPO | G01C 21/00 |

OTHER PUBLICATIONS

Cat. Special Instruction Operating Manual #7494—Operating Manual—Wheel Loader Payload Measurement System (WLPMS).

*Primary Examiner*—Jacques H. Louis-Jacques
*Attorney, Agent, or Firm*—W. Bryan McPherson

[57] ABSTRACT

The invention is a method for monitoring a work cycle of a earth moving machine on a land site. The method includes the steps of determining a direction of motion of the earth moving machine as being either a forward or a reverse direction of motion, determining a change in the direction of motion to an opposite direction of motion, determining a location of the earth moving machine on the land site where the change in direction of motion occurs, determining a condition of the land site at the location, and determining a work cycle of the earth moving machine in response to the condition.

10 Claims, 7 Drawing Sheets

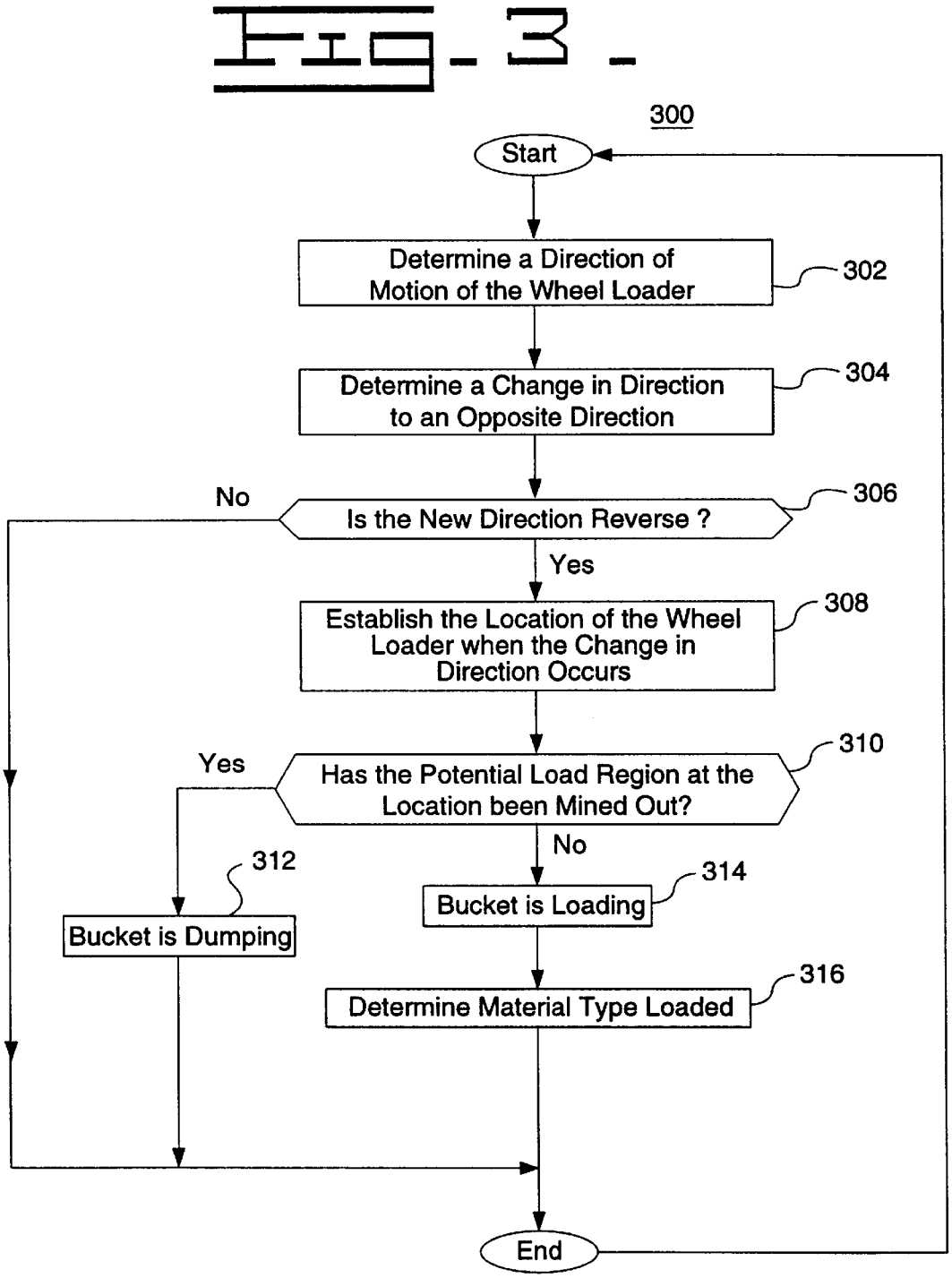
Fig. 3
300
Start
Determine a Direction of Motion of the Wheel Loader
302
Determine a Change in Direction to an Opposite Direction
304
No
Is the New Direction Reverse ?
306
Yes
Establish the Location of the Wheel Loader when the Change in Direction Occurs
308
Yes
Has the Potential Load Region at the Location been Mined Out?
310
No
312
Bucket is Dumping
Bucket is Loading
314
Determine Material Type Loaded
316
End

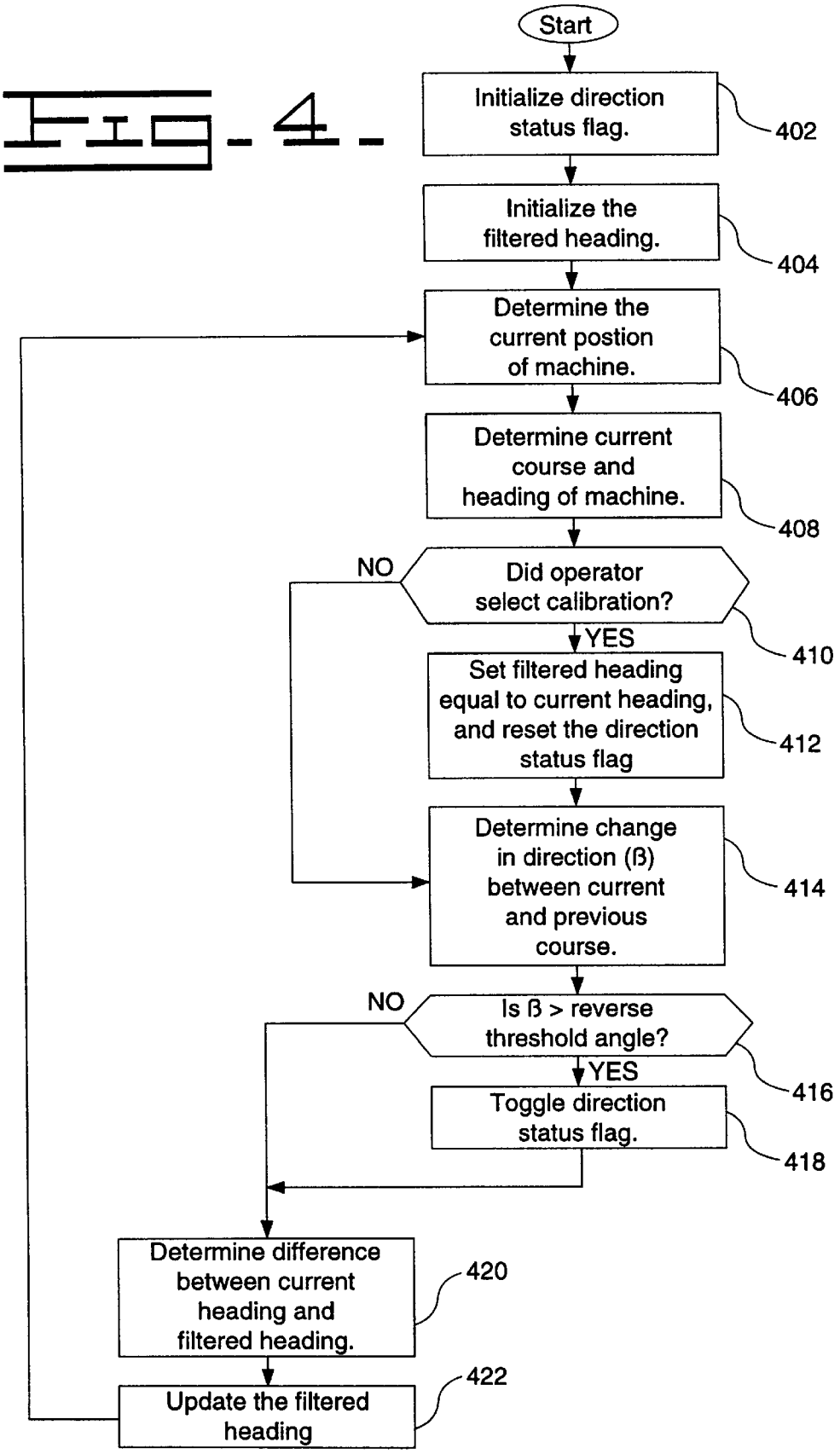
Fig-4-
Start
Initialize direction status flag.
402
Initialize the filtered heading.
404
Determine the current postion of machine.
406
Determine current course and heading of machine.
408
Did operator select calibration?
NO
YES
410
Set filtered heading equal to current heading, and reset the direction status flag
412
Determine change in direction (β) between current and previous course.
414
Is β > reverse threshold angle?
NO
YES
416
Toggle direction status flag.
418
Determine difference between current heading and filtered heading.
420
Update the filtered heading
422

METHOD FOR MONITORING THE WORK CYCLE OF EARTH MOVING MACHINERY DURING MATERIAL REMOVAL

TECHNICAL FIELD

This invention relates to the monitoring of material removal from a work site and, more particularly, to monitoring the work cycle of earth moving machinery, such as a wheel loader, on a land site.

BACKGROUND ART

The process of removing material from land sites such as mines has been aided in recent years by the development of commercially available computer software for creating digital models of the geography or topography of a site. These computerized site models can be created from site data gathered by conventional surveying, aerial photography, or, more recently, kinematic GPS surveying techniques. Using the data gathered in the survey, for example, point-by-point three-dimensional position coordinates, a digital database of site information is created which can be displayed in two or three dimensions using known computer graphics or design software.

For material removal operations such as mining it is desirable to add additional information to this database. Core samples are frequently taken over a site in order to categorize and map the different types and locations of material such as ore, as well as, the different concentrations or grades within a given ore type.

Using the above information, a mine plan can be developed. The mine plan can include an evaluation of the amount of topsoil to remove and stockpile or spread for reclamation, and identification of the amount of overburden required to be moved in order to mine the ore. Finally, the plan may include the method with which the actual ore will be mined and removed.

Generally a resource map of the site and the material to be mined is generated with boundaries corresponding to the different types and grades of ore. Surveying and stake setting crews mark the site itself with corresponding flags or stakes.

The mining of the ore is accomplished with mobile or semi-mobile loading machinery equipped with a tool such as a bucket. The loader removes the ore as indicated by the stakes and loads it one bucket at a time into a truck, for example. When the truck is filled, the truckload of ore is transported from the site for processing or stockpiling.

During the loading operation the flags or stakes marking out the various types and grades of ore are vulnerable and are easily disturbed. It may also be difficult for the operator to see the flags, depending on the available light or weather. Additionally, there may be several marked sections that look similar to the mapped area which the operator is trying to locate from the paper copy of the site model.

Because mines are typically set up to handle a given amount of material of given ore concentrations, errors in loading the wrong material from the site can be costly. If a mine inadvertently provides a mill or processing plant with material that is out of specification regarding the concentration of ore, the mine may be liable for compensating the plant for any related production consequences.

Therefore, two fundamental issues involved with mining a land site are: (1) determining the particular work cycle of the earth moving machine, e.g., when is the earth moving machine loading and dumping material, and (2) determining the type of material being mined. There are currently some solutions to solve these issues. However, these solutions consist of using expensive sensors, such as, payload monitoring systems, to determine when the bucket is being loaded, and using one or more GPS sensors to determine the location of the bucket at the work site. Because reducing the cost of mine operation is a primary concern, a low cost solution to monitoring the work cycle of a earth moving machine and the type of material being mined is desired.

The present invention is directed to overcoming one or more of the problems as set forth above by monitoring the work cycle of a mobile machine on a land site utilizing a minimal number of sensors.

DISCLOSURE OF THE INVENTION

In one aspect of the present invention, a method for monitoring a work cycle of a earth moving machine on a land site is provided. The method includes the steps of determining a direction of motion of the earth moving machine as being either a forward or a reverse direction of motion, determining a change in the direction of motion to an opposite direction of motion, determining a location of the earth moving machine on the land site where the change in direction of motion occurs, determining a condition of the land site at the location, and determining a work cycle of the earth moving machine in response to the condition.

BRIEF DESCRIPTION OF THE DRAWINGS

FIG. 3 is a high level flow diagram illustrating a method of the present invention;

FIG. 4 is a high level flow diagram illustrating a method of determining the relationship between the heading of an earthmoving machine and the course of machine travel;

BEST MODE FOR CARRYING OUT THE INVENTION

Figure 1:
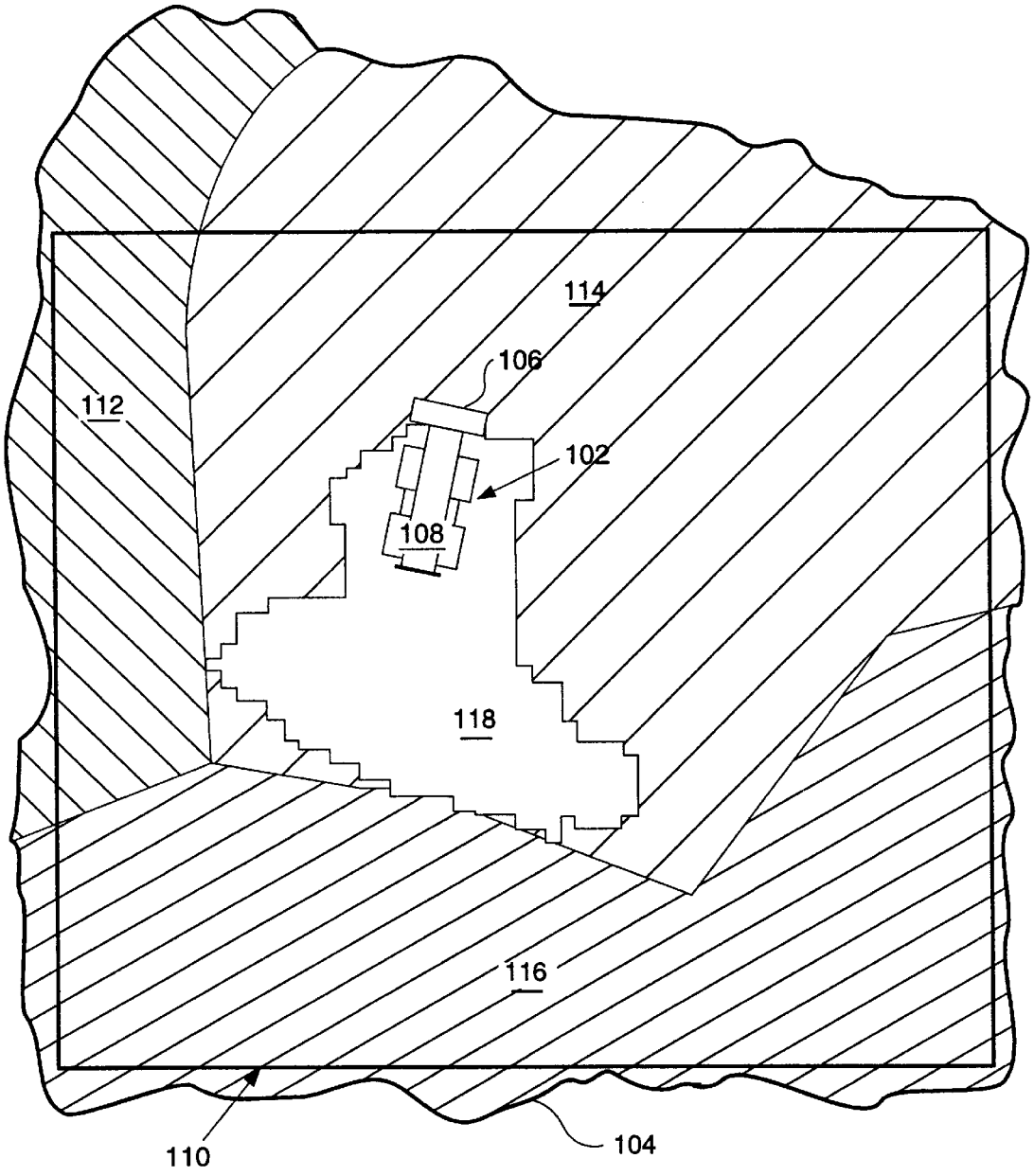
FIG. 1 is a high level diagram of a resource map displaying a land site and an earth moving machine.

The current invention provides a method for monitoring the work cycle of an earth moving machine on a land site. FIG. 1 is an illustration of an earth moving machine 102 on a land site 104. The earth moving machine 102 has a bucket 106, and a body 108. In the preferred embodiment the earth moving machine 102 includes a wheel loader; however, other types of earth moving machines are equally applicable, such as a track loader, etc. The land site 104 may be depicted in a resource map 110 which indicates the topography and type of material at a given location on the land site 104. For example, the resource map 110 of FIG. 1 illustrates a land site 104 containing a first and second material type 112, 114, and a region 116 of unknown material. The first and second material types 112, 114 may be different material types, or the same material type containing different concentrations of the material. As the wheel loader 102 travels through the land site 104 loading material, the resource map 110 is updated to indicate whether a location has been mined out. If a location has been mined out, then the resource map 110 is updated as to the topography of the mined region 118. A location has been mined out if all of the material of a desired type from the location has been loaded.

In the preferred embodiment, a work cycle of a wheel loader 102 includes a loading and a dumping operation. When a loading or dumping operation has been performed during the work cycle, it is necessary to identify the type of material that the wheel loader 102 loaded. One method of identifying the type of material loaded, which is explained later, involves defining a potential load region of the body 108 of the wheel loader 102.

Figure 2:
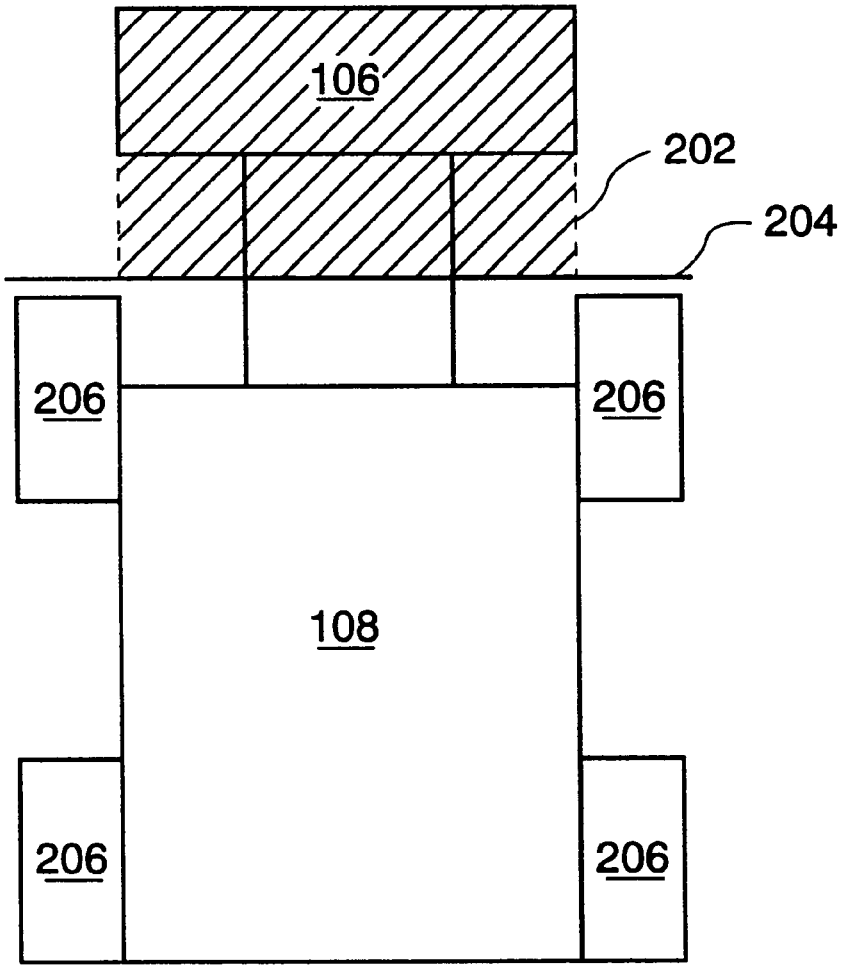
FIG. 2 is a diagram illustrating a potential load region of an earth moving machine.

FIG. 2 is an illustration of a potential load region 202. A potential load region 202 represents a portion of the land site 104 where the wheel loader 102 may have loaded material at a particular time. In the preferred embodiment, the potential load region 202 of a wheel loader 102 extends from a toe point swath line 204 to the maximum extension of the bucket 106. The toe point swath line 204 is a line that is as wide as the bucket 106, and is located slightly in front of the leading edge of the two front wheels 206 of the wheel loader 102. The position of the toe point swath line 204 and maximum extension of the bucket 106 line are known relative to the body 108. Therefore, position updates of the body 108 can be used to determine the position of the toe point swath line 204, and the maximum extension of the bucket 106 relative to the body 108. The potential load region 202 is located on the same side of the body 108 as the wheel loader bucket 106.

Referring now to FIG. 3, a flow diagram illustrating a method 300 for monitoring a work cycle of a wheel loader 102 is shown. In a first control block 302, the method determines the current direction of the wheel loader 102. For example, the direction of motion of a wheel loader 102 is either the forward or reverse direction. In a second control block 304, the method 300 determines whether the wheel loader 102 has changed to an opposite direction of motion. Continuing to a first decision block 306, the method 300 determines whether the new direction of motion is in the reverse direction. In general, a change in direction from forward to reverse indicates that the wheel loader 102 has either performed a loading operation, or a dumping operation. In the preferred embodiment, a positioning system (not shown) is used to determine the direction of the wheel loader 102 with respect to either a global reference system or a local reference system (not shown). The positioning system may include any suitable positioning system, for example, a Global Positioning System (GPS), a laser plane based system or any other suitable system or combination thereof.

With reference to FIG. 4, a flow diagram illustrating one method of determining a change in the direction of the wheel loader 102 is shown. In a first control block 402, a direction status flag is initialized. The direction status flag has two states: F (Forward) and R (Reverse). If the direction status flag of the wheel loader 102 is equal to Forward, then the front of the wheel loader 102 is pointed in the direction of travel. If the direction status flag is equal to Reverse, then the front of the wheel loader 102 is pointed in the direction opposite of travel. In the preferred embodiment, the direction status flag is initially set to Forward the first time the machine 102 is ever turned on. After the machine 102 is turned on for the first time, the state of the machine 102, including the direction status flag, is saved in a storage means (not shown) when the machine 102 is turned off, and read in from the storage means when the machine 102 is turned on, in order to maintain the previous state of the machine 102. As will be discussed later, the operator of the earthmoving machine 102 may toggle the direction status flag via a calibration switch (not shown) if the assumption regarding the direction of the machine 102 is incorrect.

In a second control block 404 a filtered heading is initialized. In the preferred embodiment, there are two characterizations of heading associated with a machine 102, a filtered heading and an instantaneous, or current heading. A current course of machine travel is determined by determining a current position and previous position of the machine 102, and translating these positions into a corresponding vector, as will be discussed later. The vector determined from the current and previous positions represents the current course. The current course of machine travel is used to determine the current heading of the machine 102 by translating the vector defining the current course, into a corresponding angle defining the current heading of the machine 102. A filtered heading is determined by storing the most recent current headings and filtering them in a manner that will be discussed later. Initially, the assumption is that the current heading is pointing in the same direction the machine 102 is moving. Therefore, in the second control block 404, the filtered heading is initialized to be pointing in the same direction of travel as the machine 102.

In a third control block 406, the current position of the earthmoving machine 102 is determined from the positioning system. In the preferred embodiment the machine 102 is required to travel a minimum distance before a new position update is determined. The minimum distance required to travel is based on the accuracy of the position estimate.

In a fourth control block 408 the current course and heading of the machine 102 are determined. In one embodiment, the current course of machine travel is determined as the vector from the previous position to the current position. In another embodiment, the course of machine travel is received from the GPS receiver. The current heading is determined by translating the current course vector into a corresponding angle.

In a first decision block 410 a determination is made as to whether a calibration flag has been set. The calibration flag is set by the operator via a calibration switch (not shown). The calibration flag enables the operator to reset the filtered heading and the direction status flag during operation of the machine 102 if desired. If the calibration flag is set, then control passes to a fifth control block 412 where the filtered heading and the direction status flag are reset. In the preferred embodiment, resetting the filtered heading is done by setting the filtered heading equal to the current heading of the machine 102. The direction status flag is reset to Forward, and then toggles between Forward and Reverse on successive calibration switch inputs. Control then passes to a sixth control block 414.

Figure 5:
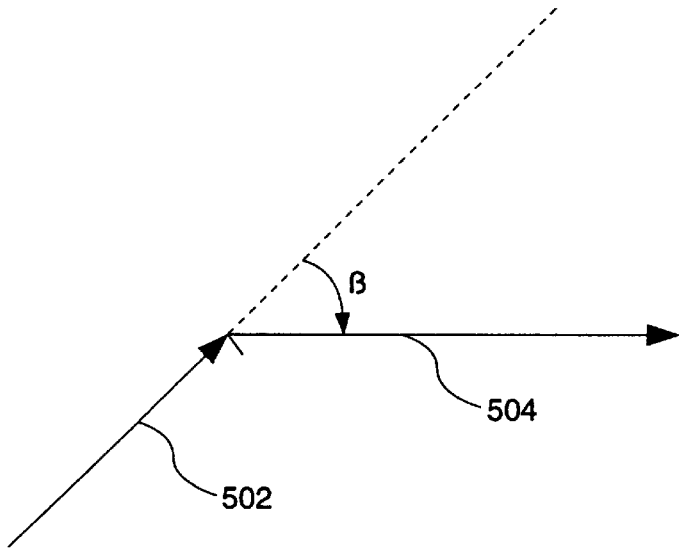
FIG. 5 is a diagram illustrating a first and second course of an earth moving machine.

If the calibration flag has not been set, then control passes directly to the sixth control block 414. In the sixth control block 414, the change in direction ($\beta$) between the current and previous course is determined. The previous course is determined as the previous current course of travel of the machine 102. As shown in FIG. 5, the previous and current courses are represented by vectors 502, 504 respectively. The change in direction in the course is represented by the angle $\beta$ as shown.

In a second decision block 416, if the angle $\beta$ is greater than a predetermined reverse threshold angle, then control passes to a seventh control block 418. The reverse threshold angle indicates the maximum turning angle a machine 102 could make between two successive position updates without changing direction of motion. If the reverse threshold angle is exceeded, then the machine 102 must have changed from a Forward to Reverse direction or vice versa. The reverse threshold angle can be different for different types of machines. In the seventh control block 418, the direction status flag is toggled indicating the change in direction, and control proceeds to an eighth control block 420.

Referring again to the second decision block 416, if the angle β is less than or equal to a predetermined reverse threshold angle, then control passes directly to the eighth control block 420.

The method shown in FIG. 4, up to the eighth control block 420, has resulted in an initial determination regarding the relationship between the current heading and the course of travel of the machine 102. The initial determination of the relationship between the current heading of the machine 102 and the course of travel will now be verified.

In an eighth decision block 420 the current heading of the machine 102 is compared with the filtered heading of the machine 102. In the preferred embodiment, comparing the current and filtered heading of the machine involves determining a heading difference between the current heading of the machine 102 and the filtered heading.

Figure 6:
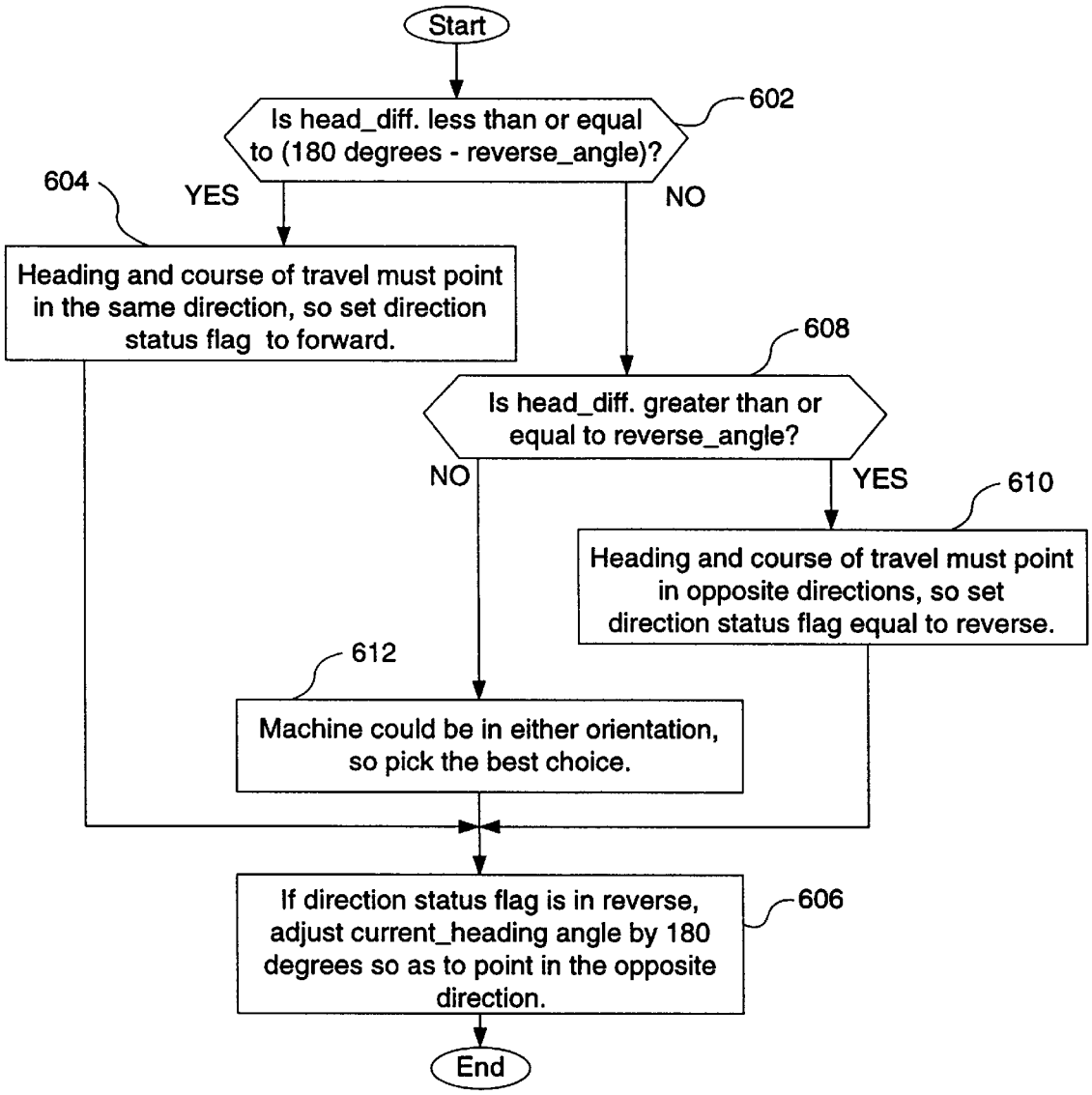
FIG. 6 is a flow diagram illustrating operation of a method for verifying the heading of the machine.

FIG. 6 expands on the eighth decision block 420 regarding the comparison between the current and filtered headings. In a first decision block 402 if the heading difference is less than or equal to the difference between 180 degrees and the reverse threshold angle, then control passes to a first control block 604. In the first control block 604, the determination is made that the heading of the machine 102 is pointed in the same direction as the course of machine travel and therefore the state of the direction status flag is Forward. The direction status flag is updated accordingly, and control is passed to a second control block 606. The angular region containing the heading difference referred to in the first control block 604 is illustrated in FIG. 7 by the angle α.

Referring again to the first decision block 602, if the heading difference is not less than or equal to the difference between 180 degrees and the reverse threshold angle, then control passes to a second decision block 608. If the heading difference is greater than or equal to the reverse threshold angle, then control passes to a third control block 610. In the third control block 610 a determination is made that the heading of the machine 102 is pointed in the opposition direction as the course of machine travel, therefore the state of the direction status flag is Reverse. The direction status flag is updated accordingly. The angular region containing the heading difference referred to in the third control block 610 is illustrated in FIG. 7 by the angle ϕ. Control then passes to the second control block 606.

Referring again to a second decision block 608, if the heading difference is not greater than or equal to the reverse angle, then control passes to a fourth control block 612. The angular region containing the heading difference referred to in the fourth control block 612 is illustrated in FIG. 7 by the angle θ.

Figure 7:
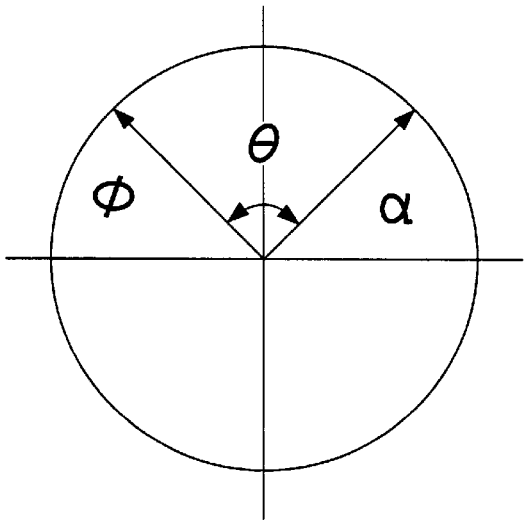
FIG. 7 is an illustration of the angular regions used to determine the heading.

As shown in FIG. 7, if control is eventually passed to the fourth control block 612, then the front of the machine 102 could be pointed in either the same direction as the course of machine travel, or opposite the course of machine travel. The heading difference θ could be either greater or less than 180 degrees divided by two. Therefore a further determination needs to be made regarding the direction of the machine.

In the fourth control block 612 a determination is made as to the relationship between the heading and course of machine travel when the heading difference lies within the angular region θ. If the heading difference is less than 180/2 degrees then the current heading of the machine 102 is pointed in the same direction as the course of machine travel, otherwise the heading of the machine 102 is pointed in the opposite direction as the course of machine travel. The direction status flag is updated accordingly. Control then passes to the second control block 606.

In the second control block 606, if the direction status flag is set to Reverse, then the current heading is modified by 180 degrees so as to point in the correct direction. The purpose of adding 180 degrees to the current heading is that when the current heading is initially calculated it is based on the current course of travel of the machine 102. If the determination is made that the state of the direction status flag is Reverse, then the course of machine travel and the current heading are actually pointed in opposite directions and the current heading needs to be modified by 180 degrees to reflect the correct relationship. Therefore 180 degrees is added to the current heading.

Referring again to FIG. 4, once the heading difference is used to verify the current heading of the machine 102 in the eighth control block 420, control passes to a ninth control block 422 where the filtered heading is updated by incorporating the current heading. In the preferred embodiment the filtered heading is updated by passing the current heading through a low pass filter. One example of such a low pass filter is the following equation:

$$\text{Filtered Heading}=(\text{Filtered Heading}*\text{Scaling Factor})+(\text{Current Heading}*(1-\text{Scaling Factor}))$$

In the preferred embodiment, the previous course and position are updated to equal to the current course and position in the ninth control block 422.

Control then passes to the third control block 406, and the method is repeated, continuously updating the current course, current heading, filtered heading and the relationship between the heading and the course of travel of the machine 102 throughout the operation of the machine 102.

Using the method described in FIG. 4, the relationship between heading of the wheel loader 102 and the course of travel of the wheel loader 102 may be determined. However, other embodiments may be used to determine this relationship, including the use of a transmission shift sensor. For example, a transmission shift sensor is capable of generating a signal indicative of the transmission of the wheel loader 102 being shifted from forward to reverse and vice versa.

Continuing with the first decision block 306 of the method 300, shown in FIG. 3, if a determination is made that the wheel loader 102 has changed directions from a reverse to a forward direction, then program control passes to the beginning of the method 300 with no determination regarding loading or dumping. Otherwise, if a determination is made that the wheel loader 102 has changed directions from a forward to a reverse direction, then the location where the wheel loader 102 actually made the change of direction is established, as shown in a third control block 308. In a second decision block 310, the method 300 determines if the potential load region 202, established at the location the change in direction occurred, has been mined out, i.e., whether all the material of a desired type located in the potential load region 202 has been loaded. A determination about whether the potential load region 206 has been mined out involves the resource map 110. In the preferred embodiment, the resource map 110 is dynamically updated as the wheel loader 102 performs the work cycle. As the wheel loader moves through the land site 104 to load and dump material, a mined region 118 is updated as being mined out. The mined region 118 is formed by determining the mined update region 602 of the land site 104.

Figure 8:
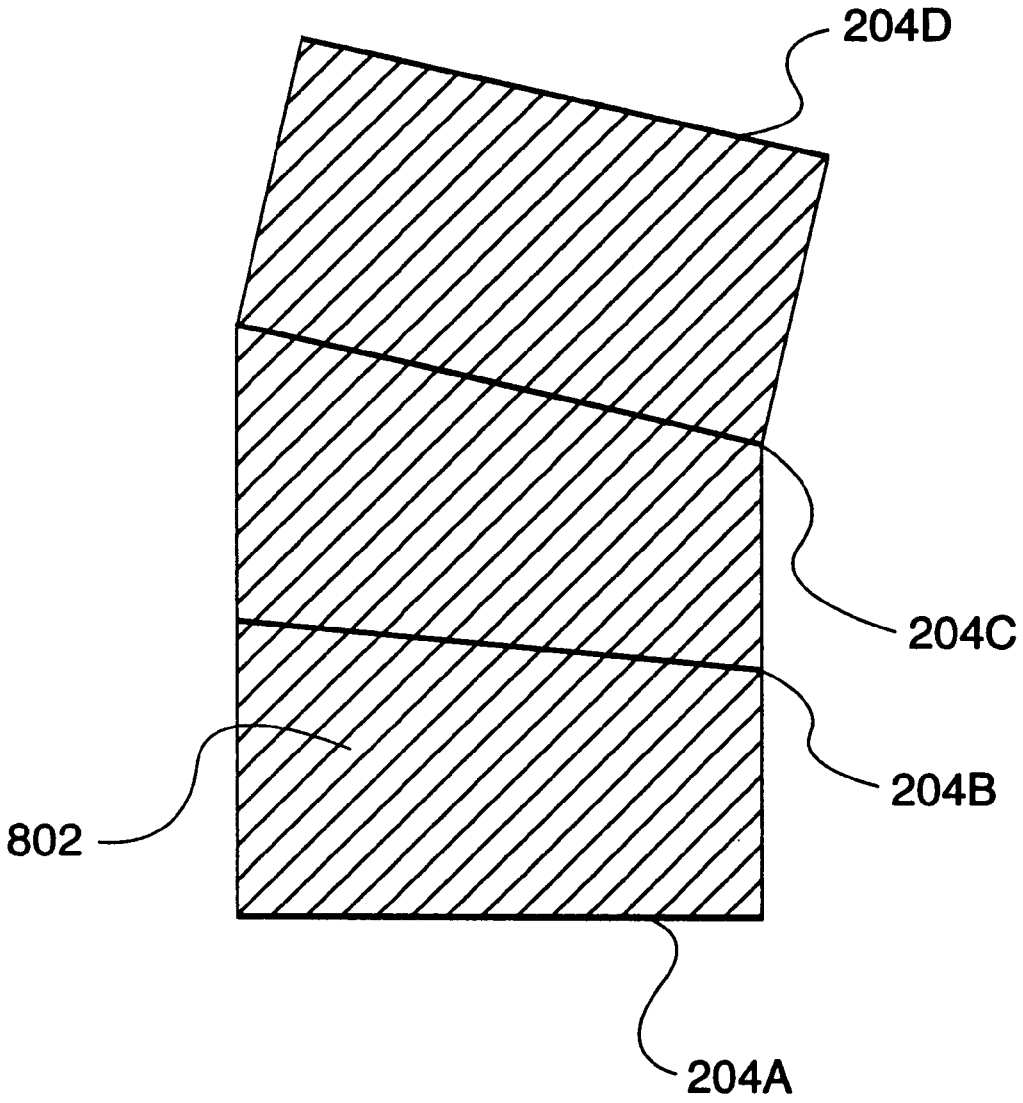
FIG. 8 is a diagram illustrating a mined update region of an earth moving machine.

FIG. 8 illustrates a mined update region 802. The mined update region 802 is established by determining the swath path between the previous and current position of the wheel loader 102. The swath path is the path covered by the toe point swath line 204 since the previous position update. For example, FIG. 8 illustrates a swath path, or mined updated region 802, which consists of a region of the land site 104 that is covered during a first, second, third, and fourth position update of the toe point swath line 204A, 204B, 204C, 204D, respectively.

While FIG. 8 illustrates the mined update region 802 after four position updates, in the preferred embodiment, the mined update region 802 is determined after every successive position update. The mined region 118 is then updated using the mined update region 802.

As the wheel loader 102 operates on the land site 104, the resource map 110 is updated based on the location of the wheel loader 102. The resource map 110 continues to be updated during the course of mining the land site 104, by updating the mined region 118. Based on the dynamically updated resource map 110, an accurate determination can be made regarding whether a potential load region 202 has been mined. In the preferred embodiment, if the resource map 110 indicates that over one half of the potential load region 202 has been mined out, then the potential load region 202, as a whole, is considered to be mined out.

Continuing with the second decision block 310 of FIG. 3, if the desired material in the potential load region 202 has been mined, then the method 300 identifies that the bucket 106 is performing a dumping operation, shown in a fourth control block 312, and control then passes to the beginning of the method 300. Otherwise, if the desired material in the potential load region 202 has not been mined out, then the method identifies that the bucket 106 is performing a loading operation, illustrated in a fifth control block 314. Finally, the method 300 determines the type of material that was loaded into the bucket 106, shown in a sixth control block 308. Using the resource map 110, the method 300 correlates the location of the potential load region 202 of the wheel loader 102 when the wheel loader 102 changes to a reverse direction, to the type of material identified on the resource map 110 at that location. The type of material on the resource map 110 in the potential load region 202 is then identified as the type of material loaded by the wheel loader 102.

The present invention is embodied in a microprocessor based system (not shown) which utilizes arithmetic units to control process according to software programs. Typically, the programs are stored in read-only memory, random-access memory or the like. The method 300 disclosed in the present invention may be readily coded using any conventional computer language.

Industrial Applicability

The present invention provides a method for monitoring a work cycle of a earth moving machine 102 on a land site 104. In the preferred embodiment, the mobile machine 102 includes a wheel loader. The disclosed method is capable of determining when the wheel loader 102 loads and dumps material, and also the type of material that was loaded. This information constitutes the work cycle of the wheel loader 102. The information can be conveyed to the operator of the wheel loader 102 through the use of a display (not shown). A resource map 110 for the land site 104, such as shown in FIG. 1, is provided to the operator through a display. The display is capable of showing the location of the wheel loader 102 on the resource map 110, the location of different types of material to be mined and the topography of the land site 104. As the wheel loader 102 mines the land site 104, the disclosed invention monitors the work cycle of the wheel loader 102 and updates the resource map 110. Monitoring the work cycle enables the wheel loader 102 to automatically keep track of how many times a particular truck is loaded, and with what type of material. Then, when the operator is finished loading a particular truck, he may simply push a transmit button that transmits information regarding the contents of the loaded truck to a central tracking facility. This alleviates the need for the operator to perform the cumbersome task of tracking the current contents of the truck being loaded.

Other aspects, objects and advantages of the present invention can be obtained from a study of the drawings, the disclosure and the appended claims.

We claim:

1. A method for monitoring a work cycle of an earth moving machine for moving material in a land site, the earth moving machine having a body and a bucket, the method including the steps of:

determining a direction of motion of said earth moving machine as being one of a forward and a reverse direction of motion;

determining a change in said direction of motion to an opposite direction of motion;

determining that said opposite direction of motion is said reverse direction of motion;

determining a location of said earth moving machine on said land site in response to said change in direction of motion to said reverse direction;

determining a condition of said land site at said location; and determining a work cycle of said earth moving machine in response to said condition.

2. A method, as set forth in claim 1, including the step of:

determining a resource map for said land site; and defining a potential load region as a portion of said land site that is located between said body and a maximum extension of said bucket.

3. A method, as set forth in claim 2, wherein the step of determining a condition of said land site includes the step of determining that said material in said potential load region is one of available to be mined and mined out.

4. A method, as set forth in claim 3, wherein the step of determining said work cycle includes the steps of:

determining that a loading operation has occurred in response to said material in said potential load region being available to be mined; and determining that a dumping operation has occurred in response to said material type in said potential load region being mined out.

5. A method, as set forth in claim 1 including the step of identifying a type of material loaded in said bucket.

6. A method, as set forth in claim 1, wherein the step of determining a change in direction includes the steps of:

determining a position of said earth moving machine in response to receiving a GPS signal; and determining a change in direction in response to receiving multiple said GPS signal.

7. A method, as set forth in claim 1, where the earth moving machine includes a transmission and, wherein the step of determining a change in direction includes the step of sensing a shift in said transmission.

8. A method for monitoring a work cycle of an earth moving machine for moving material in a land site, the earth moving machine having a body and a bucket, the method including the steps of:

determining a direction of motion of said earth moving machine as being one of a forward and a reverse direction of motion;

determining a change in said direction of motion to an opposite direction of motion;

determining that said opposite direction of motion is said reverse direction of motion;

determining a location of said earth moving machine on said land site in response to said change in direction of motion to said reverse direction;

determining a condition of said land site at said location, wherein said condition includes one of available to be mined, and mined out; and determining a work cycle of said earth moving machine in response to said condition.

9. A method, as set forth in claim 8, including the steps of:

determining a resource map for said land site; and defining a potential load region.

10. A method, as set forth in claim 8, wherein said potential load region is a portion of said land site that is located between said body and a maximum extension of said bucket.

* * * * *